US009618233B2

(12) United States Patent
Farris et al.

(10) Patent No.: US 9,618,233 B2
(45) Date of Patent: Apr. 11, 2017

(54) METHOD FOR DETERMINING WHETHER A WATER HEATER APPLIANCE IS OPERATING WITH A TIMER SWITCH

(71) Applicant: General Electric Company, Schenectady, NY (US)

(72) Inventors: Brett Alan Farris, Louisville, KY (US); Barrett Wilson Brown, Louisville, KY (US); Michelle Diana Gross, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 434 days.

(21) Appl. No.: 14/489,579

(22) Filed: Sep. 18, 2014

(65) Prior Publication Data

US 2016/0084526 A1 Mar. 24, 2016

(51) Int. Cl.
*F24H 9/20* (2006.01)
*H05B 1/02* (2006.01)

(52) U.S. Cl.
CPC ..... *F24H 9/2021* (2013.01)

(58) Field of Classification Search
None
See application file for complete search history.

(56) References Cited

FOREIGN PATENT DOCUMENTS

CN 102692078 A 9/2012

*Primary Examiner* — Thor Campbell
(74) *Attorney, Agent, or Firm* — Dority & Manning, P.A.

(57) ABSTRACT

A method for determining whether a water heater appliance is operating on a timer switch is provided. The method includes determining a power on time interval between a previous power interruption and a current power interruption if the current power interruption is a long power outage and establishing that the water heater appliance is not operating with a timer switch if the power on time interval is greater than a threshold time interval. A related water heater appliance is also provided.

17 Claims, 3 Drawing Sheets

METHOD FOR DETERMINING WHETHER A WATER HEATER APPLIANCE IS OPERATING WITH A TIMER SWITCH

FIELD OF THE INVENTION

The present subject matter relates generally to water heater appliances and timer switches for water heater appliances.

BACKGROUND OF THE INVENTION

Certain water heater appliances include a tank therein. Heating elements, such as sealed systems, gas burners, electric resistance elements, or induction elements, heat water within the tank during operation of such water heater appliances. Operating the heating elements in order to heat water within the tank consumes valuable power and/or fuel. The heating elements generally heat water within the tank to a predetermined temperature. The predetermined temperature is generally selected such that heated water within the tank is suitable for showering, washing hands, etc.

Demand for heated water often fluctuates. For example, heated water demand may be high during morning hours when residents of a house frequently take showers. Conversely, heated water demand may be lower during working hours when the same house is empty. Heated water demand may also be low during night hours when residents of the house are sleeping. Operating the heating elements in order to heat water within the tank to the predetermined temperature during periods of low heated water demand can be inefficient due to the low demand for heated water.

To limit power or fuel consumption of water heater appliances, certain users of water heater appliances equip their water heater appliances with a timer. The timer can deactivate the water heater appliance during periods of low heated water demand in order to conserve power and/or fuel. However, operating water heater appliances with a timer can cause certain difficulties.

Certain water heater appliances include an anode rod that assists with limiting or preventing corrosion of a tank. The anode rod corrodes and loses mass over time in order to protect the tank. However, corrosion of the anode rod is difficult to track. Certain water heater appliances include a circuit that tracks or measures a voltage difference between the anode rod and water within the tank in order to determine whether the anode rod is protecting the tank. However, such circuits do not track or monitor depletion of the anode rod. In addition, measuring the voltage difference between the anode rod and water within the tank with the circuit is difficult during power outages or when a timer interrupts a power supply of the water heater appliance. Thus, during power outages or timer interruptions, the anode rod may continue to corrode and protect the tank despite the circuit being unable to monitor or detect the anode rod.

Accordingly, a method for determining whether a water heater appliance operating with a timer switch would be useful. In addition, a method for tracking or monitoring depletion of an anode rod of a water heater appliance that is operating on a timer switch would be useful.

BRIEF DESCRIPTION OF THE INVENTION

The present subject matter provides a method for determining whether a water heater appliance is operating on a timer switch. The method includes determining a power on time interval between a previous power interruption and a current power interruption if the current power interruption is a long power outage and establishing that the water heater appliance is not operating with a timer switch if the power on time interval is greater than a threshold time interval. A related water heater appliance is also provided. Additional aspects and advantages of the invention will be set forth in part in the following description, or may be apparent from the description, or may be learned through practice of the invention.

In a first exemplary embodiment, a method for determining whether a water heater appliance is operating with a timer switch is provided. The method includes measuring a temperature of water within a tank of the water heater appliance at a start of a current power interruption, measuring the temperature of water within the tank of the water heater appliance at an end of the current power interruption, classifying the current power interruption as a short power outage or a long power outage based at least in part on a difference between the temperature of water within the tank of the water heater appliance at the start of the current power interruption and the temperature of water within the tank of the water heater appliance at the end of the current power interruption, determining a power on time interval between a previous power interruption and the current power interruption if the current power interruption is the long power outage at the step of classifying, and establishing that the water heater appliance is not operating with the timer switch if the power on time interval is greater than a threshold time interval.

In a second exemplary embodiment, a water heater appliance is provided. The water heater appliance includes a tank that defines an interior volume. A heating element is configured for heating water within the interior volume of the tank. An anode is mounted to the tank and extends into the interior volume of the tank. A temperature sensor is configured for measuring a temperature of water within the interior volume of the tank. A controller is in operative communication with the temperature sensor. The controller is configured for measuring the temperature of water within the interior volume of the tank with the temperature sensor at a start of a current power interruption, measuring the temperature of water within the interior volume of the tank with the temperature sensor at an end of the current power interruption, classifying the current power interruption as a short power outage or a long power outage based at least in part on a difference between the temperature of water within the interior volume of the tank at the start of the current power interruption and the temperature of water within the interior volume of the tank at the end of the current power interruption, determining a power on time interval between a previous power interruption and the current power interruption if the current power interruption is the long power outage at the step of classifying, and establishing that the water heater appliance is not operating with a timer switch if the power on time interval is greater than a threshold time interval.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
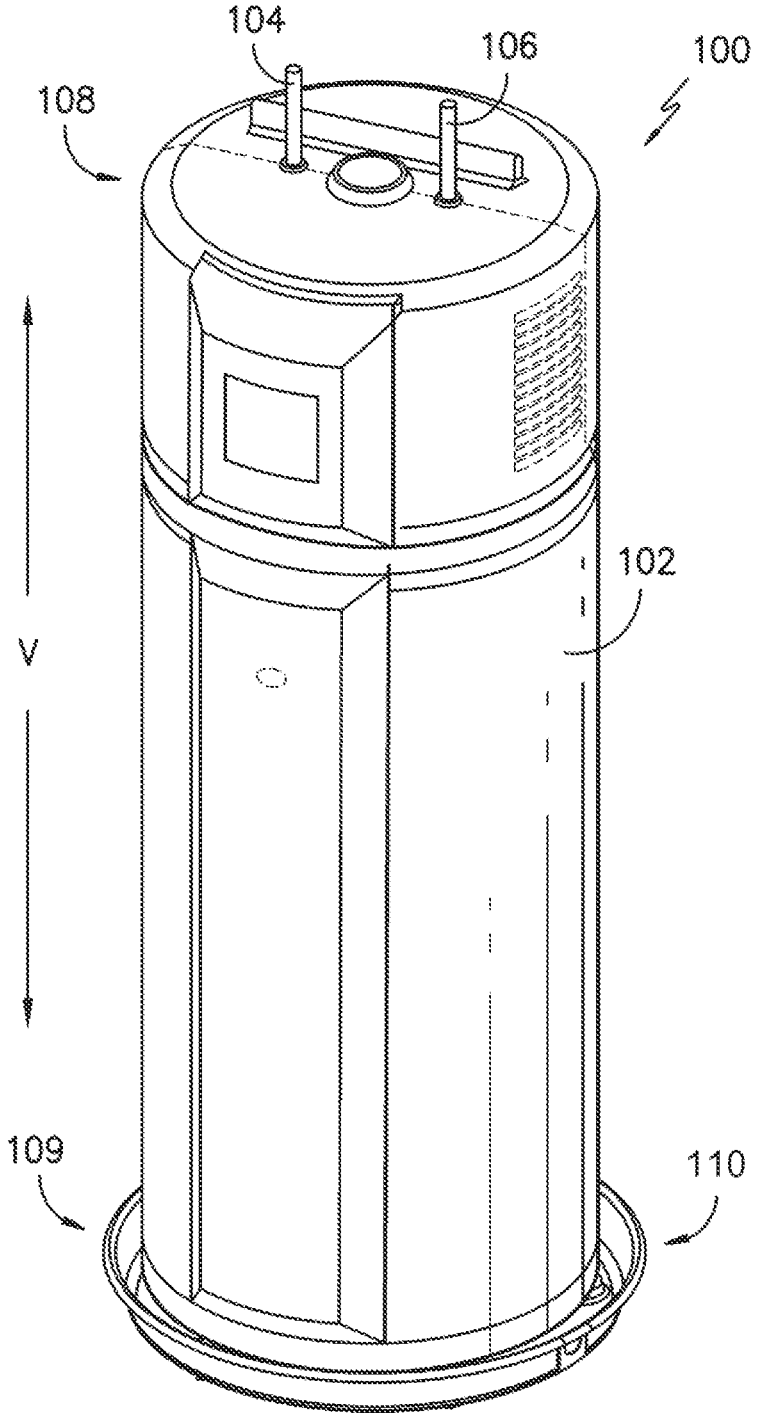
FIG. 1 provides a perspective view of a water heater appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
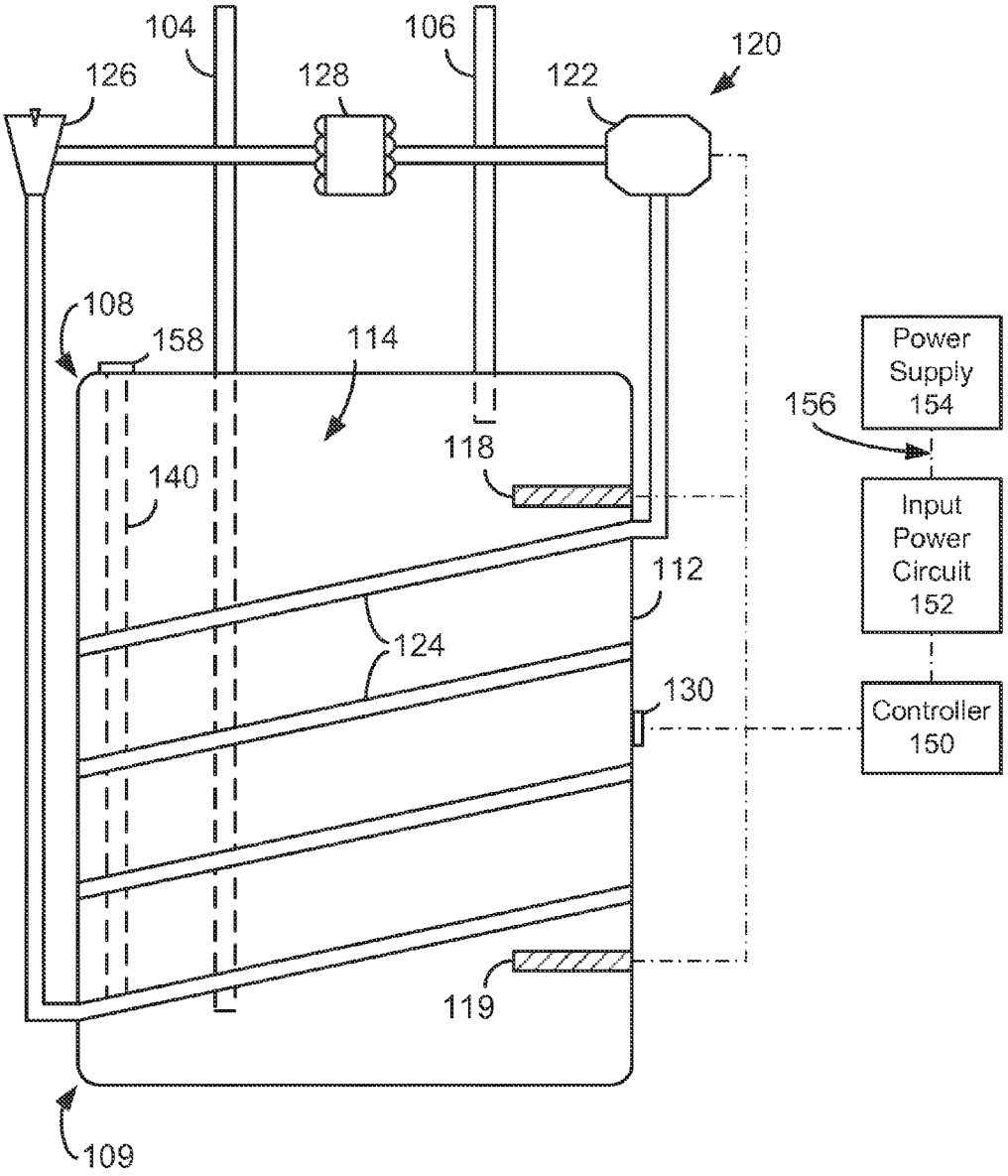
FIG. 2 provides a schematic view of certain components of the exemplary water heater appliance of FIG. 1.

FIG. 1 provides a perspective view of a water heater appliance 100 according to an exemplary embodiment of the present subject matter. FIG. 2 provides a schematic view of certain components of water heater appliance 100. Water heater appliance 100 includes a casing 102. A tank 112 (FIG. 2) is mounted within casing 102. Tank 112 defines an interior volume 114 for heating water therein.

Water heater appliance 100 also includes a cold water conduit 104 and a hot water conduit 106 that are both in fluid communication with tank 112 within casing 102. As an example, cold water from a water source, e.g., a municipal water supply or a well, enters water heater appliance 100 through cold water conduit 104. From cold water conduit 104, such cold water enters interior volume 114 of tank 112 wherein the water is heated to generate heated water. Such heated water exits water heater appliance 100 at hot water conduit 106 and, e.g., is supplied to a bath, shower, sink, or any other suitable feature.

As may be seen in FIG. 1, water heater appliance 100 extends between a top portion 108 and a bottom portion 109 along a vertical direction V. Thus, water heater appliance 100 is generally vertically oriented. Water heater appliance 100 can be leveled, e.g., such that casing 102 is plumb in the vertical direction V, in order to facilitate proper operation of water heater appliance 100.

A drain pan 110 is positioned at bottom portion 109 of water heater appliance 100 such that water heater appliance 100 sits on drain pan 110. Drain pan 110 sits beneath water heater appliance 100 along the vertical direction V, e.g., to collect water that leaks from water heater appliance 100 or water that condenses on an evaporator 128 of water heater appliance 100. It should be understood that water heater appliance 100 is provided by way of example only and that the present subject matter may be used with any suitable water heater appliance.

Turning now to FIG. 2, water heater appliance 100 includes an upper heating element 118, a lower heating element 119 and a sealed system 120 for heating water within interior volume 114 of tank 112. Thus, water heater appliance 100 is commonly referred to as a "heat pump water heater appliance." Upper and lower heating elements 118 and 119 can be any suitable heating elements. For example, upper heating element 118 and/or lower heating element 119 may be an electric resistance element, a microwave element, an induction element, or any other suitable heating element or combination thereof. Lower heating element 119 may also be a gas burner.

Sealed system 120 includes a compressor 122, a condenser 124, a throttling device 126 and an evaporator 128. Condenser 124 is thermally coupled or assembled in a heat exchange relationship with tank 112 in order to heat water within interior volume 114 of tank 112 during operation of sealed system 120. In particular, condenser 124 may be a conduit coiled around and mounted to tank 112. During operation of sealed system 120, refrigerant exits evaporator 128 as a fluid in the form of a superheated vapor and/or high quality vapor mixture. Upon exiting evaporator 128, the refrigerant enters compressor 122 wherein the pressure and temperature of the refrigerant are increased such that the refrigerant becomes a superheated vapor. The superheated vapor from compressor 122 enters condenser 124 wherein it transfers energy to the water within tank 112 and condenses into a saturated liquid and/or high quality liquid vapor mixture. This high quality/saturated liquid vapor mixture exits condenser 124 and travels through throttling device 126 that is configured for regulating a flow rate of refrigerant therethrough. Upon exiting throttling device 126, the pressure and temperature of the refrigerant drop at which time the refrigerant enters evaporator 128 and the cycle repeats itself. In certain exemplary embodiments, throttling device 126 may be an electronic expansion valve (EEV).

Water heater appliance 100 also includes a tank temperature sensor 130. Tank temperature sensor 130 is configured for measuring a temperature of water within interior volume 114 of tank 112. Tank temperature sensor 130 can be positioned at any suitable location within or on water heater appliance 100. For example, tank temperature sensor 130 may be positioned within interior volume 114 of tank 112 or may be mounted to tank 112 outside of interior volume 114 of tank 112. When mounted to tank 112 outside of interior volume 114 of tank 112, tank temperature sensor 130 can be configured for indirectly measuring the temperature of water within interior volume 114 of tank 112. For example, tank temperature sensor 130 can measure the temperature of tank 112 and correlate the temperature of tank 112 to the temperature of water within interior volume 114 of tank 112. Tank temperature sensor 130 may also be positioned at or adjacent top portion 108 of water heater appliance 100, e.g., at or adjacent an inlet of hot water conduit 106.

Tank temperature sensor 130 can be any suitable temperature sensor. For example, tank temperature sensor 130 may be a thermocouple or a thermistor. As may be seen in FIG. 2, tank temperature sensor 130 may be the only temperature sensor positioned at or on tank 112 that is configured for measuring the temperature of water within interior volume 114 of tank 112 in certain exemplary embodiments. In alternative exemplary embodiments, additional temperature sensors may be positioned at or on tank 112 to assist tank temperature sensor 130 with measuring the temperature of water within interior volume 114 of tank 112, e.g., at other locations within interior volume 114 of tank 112.

Water heater appliance 100 also includes an anode rod 140. Anode 140 is mounted to tank 112 and extends through tank 112 into interior volume 114 of tank 112. Within interior volume 114 of tank 112, anode 140 assists with limiting or preventing corrosion of tank 112. In particular, within interior volume 114 of tank 112, anode 140 may corrode rather than tank 112. In such a manner, anode 140 may assist with increasing a durability or performance of tank 112 and/or water heater appliance 100. Anode 140 may be constructed of or with any suitable material. For example, anode 140 may be constructed of or with a magnesium alloy, an aluminum alloy, combinations thereof, etc.

As may be seen in FIG. 2, water heater appliance 100 also includes a power detection circuit or input power circuit 152. Input power circuit 152 is configured to determine whether water heater appliance 100 is receiving electrical power from a power supply 154, such as a residential or commercial electric grid. Electrical power from power supply 154 may be used to operate various components of water heater appliances 100, such as upper and lower heating elements 118, 119, tank temperature sensor 130, controller 150, etc. Thus, if power supply 154 is disrupted or suspended, water heater appliance 100 may not be able to heat water within interior volume 114 of tank 112 with heating element 118, 119 and/or sealed system 120.

Water heater appliance 100 further includes a controller 150 that is configured for regulating operation of water heater appliance 100. Controller 150 is in, e.g., operative, communication with upper and lower heating elements 118 and 119, compressor 122 and tank temperature sensor 130. Thus, controller 150 may selectively activate upper and lower heating elements 118 and 119 and/or compressor 122 in order to heat water within interior volume 114 of tank 112, e.g., in response to signals from tank temperature sensor 130.

Controller 150 includes memory and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 150 may operate upper heating element 118, lower heating element 119 and/or compressor 122 in order to heat water within interior volume 114 of tank 112. As an example, a user may select or establish a set temperature, $t_s$, for water within interior volume 114 of tank 112, or the set temperature $t_s$ for water within interior volume 114 of tank 112 may be a default value. Based upon the set temperature $t_s$ for water within interior volume 114 of tank 112, controller 150 may selectively activate upper heating element 118, lower heating element 119 and/or compressor 122 in order to heat water within interior volume 114 of tank 112 to the set temperature $t_s$ for water within interior volume 114 of tank 112. The set temperature $t_s$ for water within interior volume 114 of tank 112 may be any suitable temperature. For example, the set temperature $t_s$ for water within interior volume 114 of tank 112 may be between about one hundred degrees Fahrenheit and about one hundred and eighty-degrees Fahrenheit.

As discussed above, input power circuit 152 is configured for determining whether water heater appliance 100 is receiving electrical power from power supply 154. Thus, input power circuit 152 may signal controller 150 when electrical power from power supply 154 is interrupted and when electrical power from power supply 154 is restored. Input power circuit 152 may be any suitable type of circuit. For example, input power circuit 152 may be a voltmeter, a current meter, etc.

Figure 3:
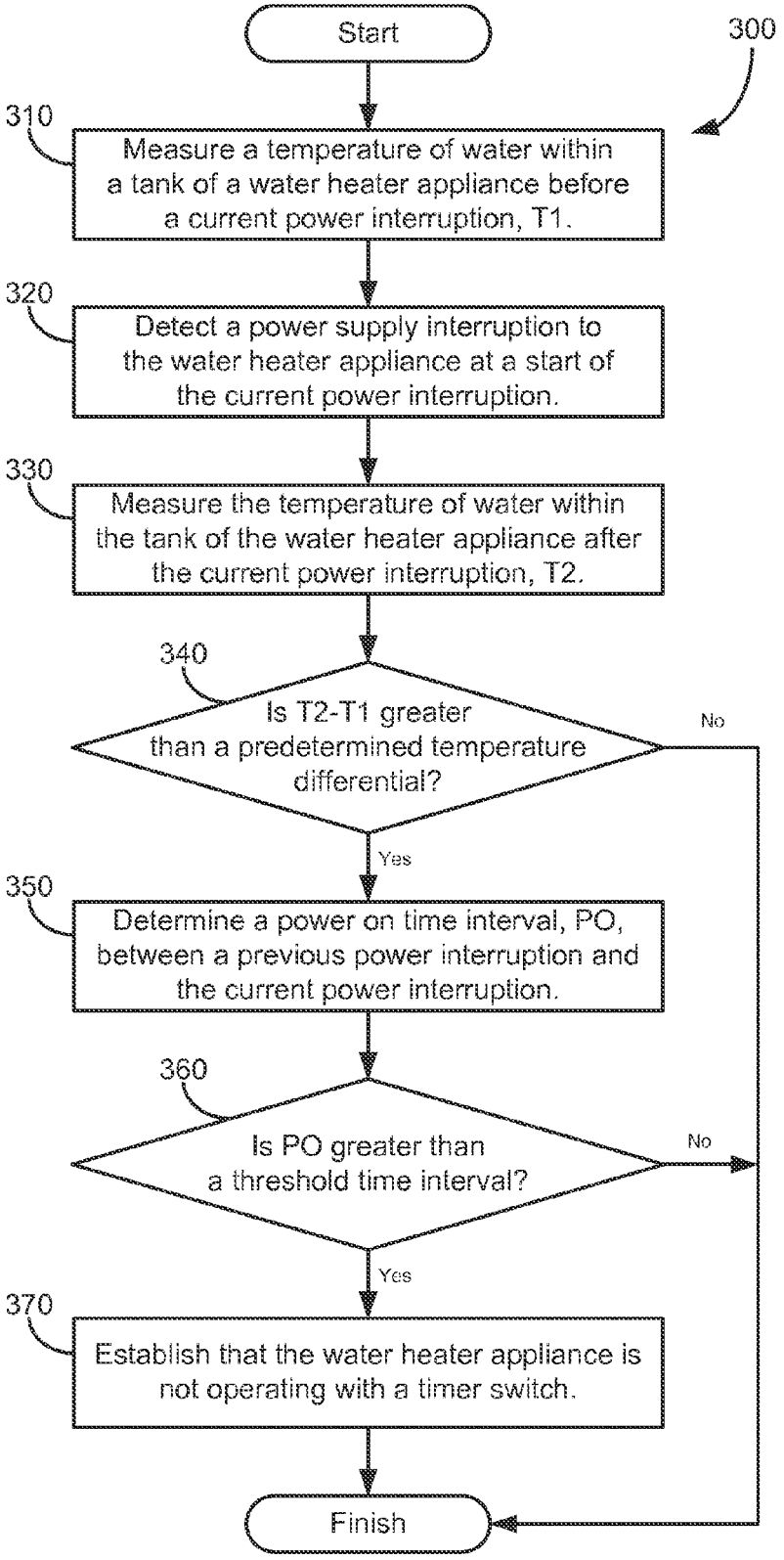
FIG. 3 illustrates a method for determining whether a water heater appliance is operating with a timer switch according to an exemplary embodiment of the present subject matter.

FIG. 3 illustrates a method 300 for determining whether a water heater appliance is operating with a timer switch according to an exemplary embodiment of the present subject matter. Method 300 can be used with any suitable water heater appliance. For example, method 300 may be used with water heater appliance 100 (FIG. 1). Controller 150 may be programmed or configured to implement method 300. Utilizing method 300, controller 150 may determine or establish when water heater appliance 100 is operating with a timer switch that periodically deactivates or turns off water heater appliance 100. Method 300 may also include steps for monitoring or tracking depletion of anode 140 when water heater appliance 100 is unpowered or deactivated, e.g., by a timer switch.

As discussed above, water heater appliance 100 receives electrical power from power supply 154 to operate various components of water heater appliance 100, such as upper and lower heating elements 118, 119, tank temperature sensor 130, controller 150, etc. Power supply 154 may be interrupted for a variety of reasons. For example, power outage events may disrupt power supply 154. Power outage events include electrical grid glitches or malfunctions, storms and bad weather, and vehicles or tree limbs that strike power lines of power supply 154. As another example, power supply 154 may be deactivated by a load shedding program of an associated power company.

Water heater appliance 100 may also include timer switch that disrupts or disconnects the connection between power supply 154 and water heater appliance 100, e.g., at periodic or predetermined times. The timer switch may be installed at a location 156 between power supply 154 and water heater appliance 100. For example, the timer switch may be installed on an outlet. The timer switch may be programmed to terminate or interrupt the electrical connection between power supply 154 and water heater appliance 100 at specified times. As an example, the timer switch may terminate or interrupt the electrical connection between power supply 154 and water heater appliance 100 during periods of low heated water demand, such as nighttime hours between eleven pm and four am or working hours between ten am and four pm. In such a manner, the timer switch may deactivate water heater appliance 100 in order to reduce energy consumption and operating costs of water heater appliance 100, e.g., during periods of low heated water demand.

As discussed above, method 300 may assist with determining or establishing when water heater appliance 100 is operating with the timer switch. Method 300 may utilize temperature measurements and/or time intervals during and between power outages in order to determine or establish when water heater appliance 100 is operating with a timer switch. During power outages, water heater appliance 100 is not supplied with electrical power from power supply 154. Power outages may be detected using power input circuit 152. For example, power input circuit 152 may signal controller 150 when power supply 154 is interrupted or suspended.

At step 310, a temperature of water within interior volume 114 of tank 112 is measured at a start of or before a current power interruption. The current power interruption corresponds to an interruption or suspension of electrical power from power supply 154 to water heater appliance 100, e.g., during method 300. However, at step 310, power supply 154 is providing electrical power to water heater appliance 100. Controller 150 may receive a signal from tank temperature sensor 130 corresponding to the temperature of water within interior volume 114 of tank 112 at step 310. In particular, controller 150 may receive the signal from tank temperature sensor 130 before input power circuit 152 detects that the power supplied to water heater appliance 100 is interrupted by the current power interruption. In alternative exemplary embodiments, controller 150 may receive the signal from tank temperature sensor 130 immediately after input power circuit 152 detects that the power supplied to water heater appliance 100 is interrupted by the current power interruption. Tank temperature sensor 130 may be powered by a capacitor or battery in order to permit operation of tank temperature sensor 130 immediately after the current power interruption.

At step 320, the current power interruption is detected, e.g., with input power sensor circuit 152. For example, when the current power interruption begins, power sensor circuit 152 may signal controller 150. Power sensor circuit 152 may include or be powered by a capacitor or battery in order to permit power sensor circuit 152 to signal controller 150 at step 320.

At step 330, the temperature of water within interior volume 114 of tank 112 is measured at an end of or after the current power interruption. Thus, at step 330, power supply 154 is providing electrical power to water heater appliance 100. Controller 150 may receive a signal from tank temperature sensor 130 corresponding to the temperature of water within interior volume 114 of tank 112 at step 330. In particular, controller 150 may receive the signal from tank temperature sensor 130, e.g., immediately, after input power circuit 152 detects that the power supplied to water heater appliance 100 is reestablished after the current power interruption.

At step 340, the current power interruption is classified as a short power outage or a long power outage, e.g., based at least in part on a difference between the temperature of water within interior volume 114 of tank 112 before the current power interruption measured at step 310 and the temperature of water within interior volume 114 of tank 112 after the current power interruption measured at step 330. For example, controller 150 may compare the difference between the temperature of water within interior volume 114 of tank 112 before the current power interruption measured at step 310 and the temperature of water within interior volume 114 of tank 112 after the current power interruption measured at step 330 to a predetermined temperature differential in order to classify the current power interruption as the short power outage or the long power outage at step 340. In particular, controller 150 may classify the current power interruption as the short power outage if the difference between the temperature of water within interior volume 114 of tank 112 before the current power interruption measured at step 310 and the temperature of water within interior volume 114 of tank 112 after the current power interruption measured at step 330 is less than the predetermined temperature differential at step 340. Conversely, controller 150 may classify the current power interruption as the long power outage if the difference between the temperature of water within interior volume 114 of tank 112 before the current power interruption measured at step 310 and the temperature of water within interior volume 114 of tank 112 after the current power interruption measured at step 330 is greater than or equal to the predetermined temperature differential at step 340. In such manner, controller 150 may classify the current power outage as the short power outage if the temperature of water within interior volume 114 of tank 112 does not drop significantly during the current power outage, and controller 150 may classify the current power outage as the long power outage if the temperature of water within interior volume 114 of tank 112 drops significantly during the current power outage. The predetermined temperature differential may be any suitable temperature. For example, the predetermined temperature may be less than or equal to one degree Fahrenheit, less than or equal to two degrees Fahrenheit, less than or equal to three degrees Fahrenheit, etc.

If the current power interruption is the short power outage at step 340, method 300 may ignore the current power outage and any depletion of anode 140 during the short power outage. If the current power interruption is the long power outage at step 340, a power on time interval between a previous power interruption and the current power interruption may be determined at step 350. The previous power interruption may correspond to an interruption or suspension of electrical power from power supply 154 to water heater appliance 100, e.g., immediately, prior to or preceding the current power outage. As an example, controller 150 may calculate the power on time interval between the previous power interruption and the current power interruption using a real-time clock (not shown) of controller 150.

At step 360, controller 150 compares the power on time interval to a threshold time interval. At step 370, controller 150 establishes that water heater appliance 100 is not operating with the timer switch if the power on time interval is greater than the threshold time interval. Thus, if the previous power interruption and the current power interruption are temporally spaced apart from each other by at least the threshold time interval, controller 150 establishes that water heater appliance 100 is not operating with the timer switch. The threshold time interval may be any suitable time interval. For example, the threshold time interval may be greater than or equal to three days. As another example, the threshold time interval may be greater than or equal to four days. Thus, if at least four days passes between the previous power interruption and the current power interruption, controller 150 may establish that water heater appliance 100 is not operating with the timer switch. In such manner, method 300 may establish that water heater appliance 100 is not operating with the timer switch.

Method 300 may also include establishing that water heater appliance 100 is operating with the timer switch if at least five sequential long power outages occur with less than twenty-four hours between each long power outage of the at least five sequential long power outages and a respective subsequent long power outage of the at least five sequential long power outages. Thus, if less than twenty-four hours passes between sequential long power outages, the frequent long power outages may suggest that water heater appliance 100 is operating with the timer switch. The number (e.g., five) of sequential long power outages may also confirm or controvert that water heater appliance 100 is operating with the timer switch.

In addition, method 300 may also include estimating a depletion of anode 140, e.g., during long power outages. For example, controller 150 may calculate or determine a power off time interval of water heater appliance 100 during the current power interruption, e.g., if water heater appliance 100 is operating with the timer switch. For example, a real-time clock (not shown) of controller 150 may measure a duration of the current power interruption in order to calculate or determine the power off time interval of water heater appliance 100. The real-time clock of controller 150 may be powered by a capacitor or battery during the current power interruption.

Controller 150 may also estimate depletion of anode 140 during the current power interruption based at least in part on a current through anode 140 over time and the power off time interval. For example, controller 150 may estimate depletion of anode 140 during a single day with the following:

IF (All ON times>=12 hours)→[On time×current]+
(([ON time×current]/hoursON)×(24-hoursON))

IF (All ON times<12 hours)→[ON time×current]+
([ON time×current]/2)

IF (Some ON times are>=12 hours&some ON times
are<12 hours)→[ON time×current]×1.5 where: ON times correspond to periods between sequential long power interruptions when power supply 154 supplies electrical power to water heater appliance 100 during the single day; current corresponds to a current through anode 40 during all ON times during the single day; and hoursON corresponds to the sum of ON times during the single day. In such a manner, controller 150 may estimate depletion of anode 140 despite long power interruptions depowering controller 150. It should be understood that any other suitable method may be used to estimate depletion of anode 140 in alternative exemplary embodiments. Thus, the example provided above is provided by way of example only.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for determining whether a water heater appliance is operating with a timer switch, comprising:

measuring a temperature of water within a tank of the water heater appliance at a start of a current power interruption;

measuring the temperature of water within the tank of the water heater appliance after the current power interruption;

classifying the current power interruption as a short power outage or a long power outage based at least in part on a difference between the temperature of water within the tank of the water heater appliance at the start of the current power interruption and the temperature of water within the tank of the water heater appliance at the end of the current power interruption;

determining a power on time interval between a previous power interruption and the current power interruption if the current power interruption is the long power outage at said step of classifying; and establishing that the water heater appliance is not operating with the timer switch if the power on time interval is greater than a threshold time interval.

2. The method of claim 1, wherein the threshold time interval is greater than or equal to three days.

3. The method of claim 2, wherein the threshold time interval is greater than or equal to four days.

4. The method of claim 1, further comprising monitoring a power input of the water heater appliance with an input power circuit of the water heater appliance in order to detect the current power interruption and the previous power interruption.

5. The method of claim 4, wherein said step of measuring the temperature of water within the tank of the water heater appliance at the start of the current power interruption comprises measuring the temperature of water within the tank of the water heater appliance before the input power circuit of the water heater appliance detects that the power supplied to the water heater appliance is interrupted by the current power interruption, and wherein said step of measuring the temperature of water within the tank of the water heater appliance at the end of the current power interruption comprises measuring the temperature of water within the tank of the water heater appliance after the input power circuit of the water heater appliance detects that the power supplied to the water heater appliance is reestablished after the current power interruption.

6. The method of claim 1, wherein said step of establishing further comprises establishing that the water heater appliance is operating with the timer switch if at least five sequential long power outages occur with less than twenty-four hours between each long power outage of the at least five sequential long power outages and a respective subsequent long power outage of the at least five sequential long power outages.

7. The method of claim 1, further comprising calculating a power off time interval of the water heater appliance during the current power interruption if the water heater appliance is operating with the timer switch.

8. The method of claim 7, further comprising estimating depletion of an anode of the water heater appliance during the current power interruption based at least in part on a current through the anode over time and the power off time interval of the water heater appliance during the current power interruption.

9. The method of claim 1, wherein the water heater appliance is not supplied with electrical power during the current power interruption.

10. A water heater appliance, comprising:

a tank defining an interior volume;

a heating element configured for heating water within the interior volume of the tank;

an anode mounted to the tank and extending into the interior volume of the tank;

a temperature sensor configured for measuring a temperature of water within the interior volume of the tank;

a controller in operative communication with the temperature sensor, the controller configured for measuring the temperature of water within the interior volume of the tank with the temperature sensor at a start of a current power interruption;

measuring the temperature of water within the interior volume of the tank with the temperature sensor at an end of the current power interruption;

classifying the current power interruption as a short power outage or a long power outage based at least in part on a difference between the temperature of water within the interior volume of the tank at the start of the current power interruption and the temperature of water within the interior volume of the tank at the end of the current power interruption;

determining a power on time interval between a previous power interruption and the current power interruption if the current power interruption is the long power outage at said step of classifying; and establishing that the water heater appliance is not operating with a timer switch if the power on time interval is greater than a threshold time interval.

11. The water heater appliance of claim 10, wherein the threshold time interval is greater than or equal to three days.

12. The water heater appliance of claim 11, wherein the threshold time interval is greater than or equal to four days.

13. The water heater appliance of claim 10, further comprising an input power circuit configured to determine whether the water heater appliance is receiving electrical power, the controller being in operative communication with the input power circuit and configured for monitoring a power input of the water heater appliance in order to detect the current power interruption and the previous power interruption.

14. The water heater appliance of claim 13, wherein said step of measuring the temperature of water within the interior volume of the tank with the temperature sensor at the start of the current power interruption comprises measuring the temperature of water within the interior volume of the tank with the temperature sensor before the input power circuit detects that the power supplied to the water heater appliance is interrupted by the current power interruption, and wherein said step of measuring the temperature of water within the interior volume of the tank with the temperature sensor at the end of the current power interruption comprises measuring the temperature of water within the interior volume of the tank with the temperature sensor after the input power circuit detects that the power supplied to the water heater appliance is reestablished after the current power interruption.

15. The water heater appliance of claim 10, wherein said step of establishing further comprises establishing that the water heater appliance is operating with the timer switch if at least five sequential long power outages occur with less than twenty-four hours between each long power outage of the at least five sequential long power outages and a respective subsequent long power outage of the at least five sequential long power outages.

16. The water heater appliance of claim 10, wherein the controller is further configured for calculating a power off time interval during the current power interruption if the water heater appliance is operating with the timer switch.

17. The water heater appliance of claim 16, wherein the controller is further configured for estimating depletion of the anode during the current power interruption based at least in part on a current through the anode over time and the power off time interval during the current power interruption.

* * * * *